United States Patent [19]

Van Slett

[11] Patent Number: 5,011,027

[45] Date of Patent: Apr. 30, 1991

[54] SUSPENSION SYSTEM FOR DISPLAYING EYEGLASS FRAMES

[75] Inventor: Peter J. Van Slett, Wauwatosa, Wis.

[73] Assignee: Eyecare One Corp., Wauwatosa, Wis.

[21] Appl. No.: 474,622

[22] Filed: Jan. 26, 1990

Related U.S. Application Data

[63] Continuation of Ser. No. 272,229, Nov. 16, 1988, abandoned.

[51] Int. Cl.[5] ..... A47F 7/00

[52] U.S. Cl. ..... 211/13; 248/902

[58] Field of Search ..... 211/13, 113, 119, 189, 211/190, 186, 187, 181, 183; 248/902, 245; 108/144, 111

[56] References Cited

U.S. PATENT DOCUMENTS

| | | | |
|---|---|---|---|
| 2,713,947 | 7/1955 | Foster | 248/902 |
| 2,966,271 | 12/1960 | Nadel | 248/902 |
| 4,204,602 | 5/1980 | Dunchock | 248/902 |
| 4,558,788 | 12/1985 | Grothaus | 248/902 |
| 4,787,520 | 11/1988 | Pearson | 248/902 |
| 4,805,781 | 2/1989 | Tegel | 248/902 |

OTHER PUBLICATIONS

Mobile Cable Systems, Northfield, Ill., catalog, pp. 7-11, *The Function of Our Form is to Disappear*, filed 2/8/89.

*Primary Examiner*—Sarah A. Lechok

*Attorney, Agent, or Firm*—Michael, Best & Friedrich

[57] ABSTRACT

Display units for products such as eyeglass frames and including a frame and apparatus for adjustably supporting a plurality of eyeglass display shelves. The apparatus for supporting display shelves includes a cable assembly having a plurality of vertical cables, each vertical cable being supported by the display device frame, and a plurality of shelves suspended from the cables such that the position of the shelves can be readily adjusted.

23 Claims, 3 Drawing Sheets

SUSPENSION SYSTEM FOR DISPLAYING EYEGLASS FRAMES

This is a continuation of patent application Ser. No. 272,229 filed on Nov. 16, 1988, now abandoned.

FIELD OF INVENTION

The invention relates to display devices and more particularly to apparatus for use in displaying products such as eyeglass frames and the like.

BACKGROUND PRIOR ART

In clinics and retail establishments of the type selling eyeglasses and frames for eyeglasses, the frames are commonly supported on wall mounted shelving or in floor mounted cases. These display devices frequently do not provide for efficient use of retail space and may not provide attractive display areas if the geometry of the display space is not suited specifically for retail sales of eyeglass frames. Additionally, retail space used for optical clinics and retail establishments selling eyeglasses frequently may not have sufficient wall space suitable for displaying sufficient numbers of eyeglass frames, or may not permit attractive display of the eyeglass frames. The retail space may also have large central open areas not useful for display of eyeglass frames, or the space may otherwise be of a geometry which makes attractive display of the eyeglass frames difficult. Additionally, wall mounted display shelves may be time consuming to install and are not conveniently moved from one retail establishment to the other.

In other applications, shelving has been supported by cables or rods having upper ends anchored to a ceiling and with lower ends anchored to the floor. Such shelving systems are distributed by Mobile Cable Systems, Northfield, Ill. and are described in a catalog titled *The Function of Our Form is to Disappear.*

SUMMARY OF THE INVENTION

The invention provides means for displaying eyeglass frames and other retail products in a manner which facilitates efficient use of the available retail space in commercial buildings and facilitates arrangement of the displays in various manners depending upon the geometry of the available commercial space. The display devices embodying the invention maximize the use of the space permitting display of eyeglass frames and other products in the most attractive manner for the space available. For example, retail space is commonly comprised of narrow rooms extending from the front of the building rearwardly. The display devices embodying the invention facilitate attractive and efficient displays of products despite the limitations of such retail space.

The invention includes display units for products such as eyeglass frames, the display units including a frame, a plurality of shelves each intended to support a number of pairs of eyeglass frames and apparatus for adjustably supporting the eyeglass display shelves. The shelves included in the apparatus of the invention have a configuration providing a convenient means for supporting eyeglass frames in an attractive manner, and the shelves are constructed such that they can be supported by a plurality of vertically extending cables adapted to support the shelves such that the position of the shelves can be readily adjusted and such that the shelves can be inserted into the display units or removed. The vertically extending cables for supporting the shelves each include upper and lower ends supported by the display unit frame.

The display devices can be self-supporting and free-standing such that they can be positioned as required by the configuration of the retail space, and the display devices need not be secured to a wall or otherwise fixed in place. Accordingly, the display devices can be manufactured in a location remote from the retail space and can be conveniently moved from one retail area to another. Another advantage of the display device embodying the invention is that the cables and the display shelves can be assembled and installed by store personnel and without assistance from craftsmen or workmen otherwise required to mount shelving on the walls. Additionally, the cable and shelving arrangement permits store personnel to readily adjust the relative vertical position of the shelving as required by the products being displayed.

One of the advantages of the invention is that displays can be free-standing and provide an attractive display in a central portion of a display area of a retail establishment. Additionally, both sides of the display device can be used for support of display shelving.

Various other features and advantages of the invention will be apparent by reference to the following description of a preferred embodiment, from the drawings and from the claims.

BRIEF DESCRIPTION OF THE DRAWINGS

FIG. 8 is an enlarged perspective view of a display shelf illustrated in FIG. 7.

Figure 2:
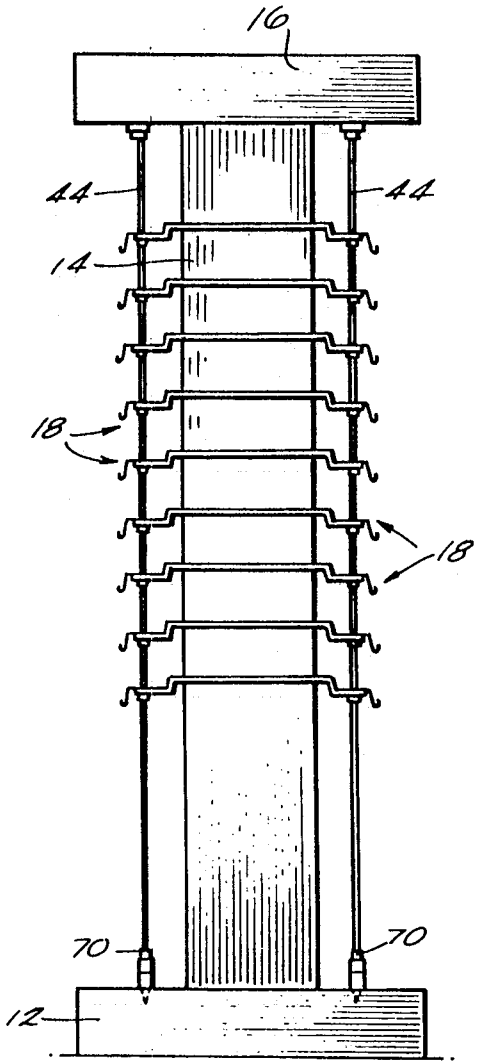
FIG. 2 is a side elevation view of the display device shown in FIG. 1.

Before describing one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Figure 1:
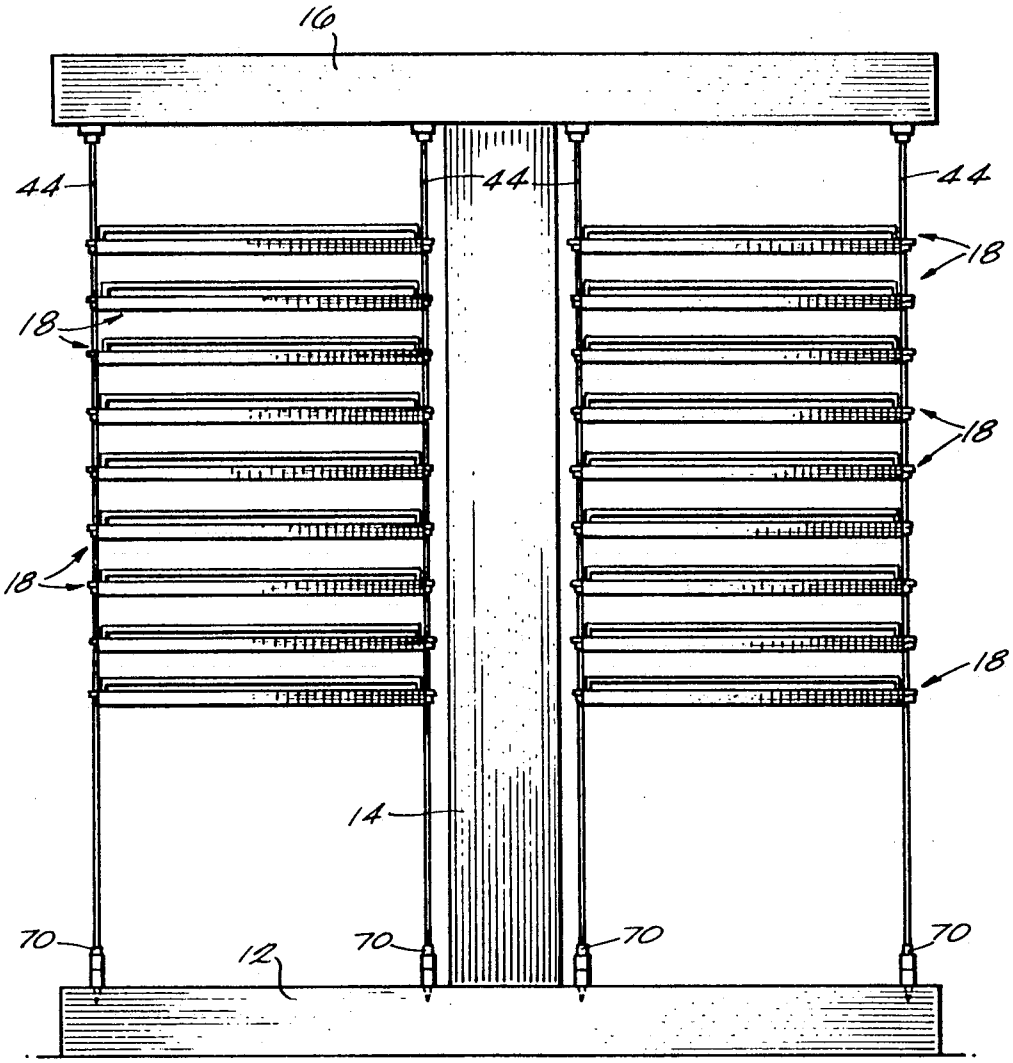
FIG. 1 is an elevation view of a free-standing display case embodying the invention.

Illustrated in FIG. 1 is a display case 10 embodying the invention, and for use in displaying eyeglass frames in retail sales of eyeglass frames and eyeglasses. The display case 10 includes a base 12 adapted to be supported on a floor and a vertically extending support column 14 projecting upwardly from a central portion of the base 12. The vertical support column 14 supports an upper frame or top portion 16 which may house light fixtures (not shown) for use in illuminating eyeglass frames or other products being displayed.

In the specific arrangement of the invention shown in FIGS. 1 and 2, the display devices include a plurality of shelf units 18 supported in vertically stacked, spaced apart relation between the base 12 and the top 16 of the display case, the shelf units 18 each being adapted to support a plurality of eyeglass frames or similar products. In the specific arrangement shown in the drawings, two stacks or columns of shelf units 18 are shown, but it will be understood that the display device could include one or more stacks or columns of shelf units.

Figure 3:
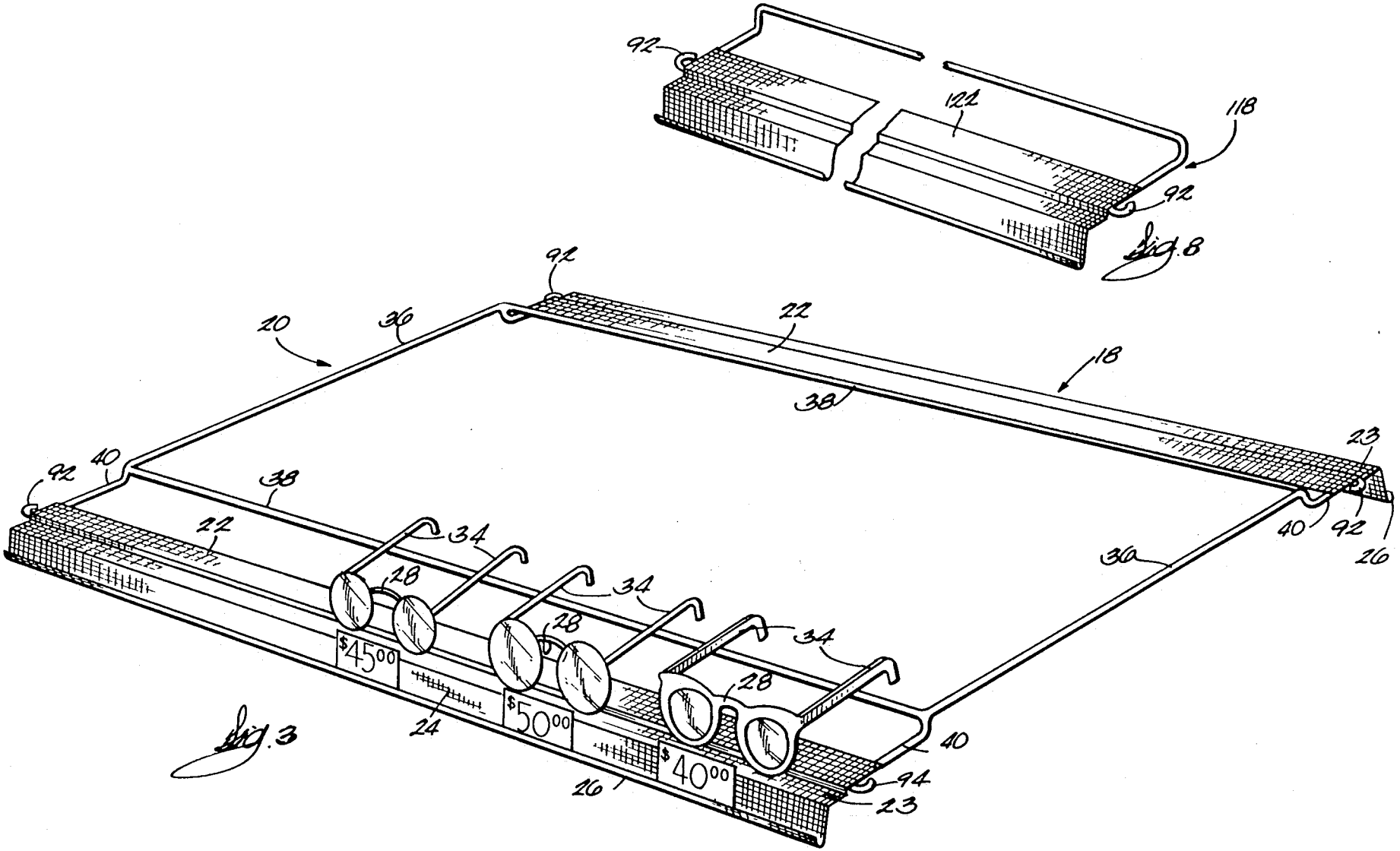
FIG. 3 is an enlarged perspective view of a display shelf of the display device shown in FIGS. 1 and 2.

As illustrated in FIG. 3, each shelf unit is comprised of a rigid frame 20 supporting a pair of shelves 22, each shelf having a forward shelf edge including a configuration for supporting a plurality of eyeglass frames in side-by-side relation. In the illustrated arrangement, each shelf 22 includes a front edge 23 adapted to house and support the bottom portion of a plurality of eyeglasses or eyeglass frames 28. Each shelf also includes a downwardly inclined forward face 24 extending downwardly from the front edge and having a lower edge terminating in an upwardly curved lip or trough portion 26. While the shelves 22 could be comprised of various materials, in the illustrated arrangement they are comprised of a screen or mesh material. The rigid frame 20 is comprised of a pair of elongated relatively rigid rods 36 defining the opposite ends of the shelf unit, the rods 36 being joined by a pair of parallel spaced apart connecting rods 38 extending parallel to and spaced inwardly from the shelves 22. In a preferred form of the invention, the ends 40 of rods 36 are bent in the manner shown in FIGS. 3 and 4 such that connecting rods 38 are positioned slightly above the upper surfaces of the shelves 22 and such that the rearward ends of the eyeglass frame bows 34 can be supported on the connecting rods 38.

In the illustrated arrangement the opposite ends of the shelves 22 are also welded or otherwise fixed to the ends 40 of the rods 36 defining the sides of the shelf units 18 to thereby provide structural support and rigidity to the shelf unit.

While in the illustrated arrangement both sides of the shelf units are provided with eyeglass frame supporting shelves 22, in other constructions only a single eyeglass frame supporting shelf 22 could be provided.

Means are also provided for supporting or suspending the shelf units 18 in vertically stacked relation between the base 12 and the top portion 16 of the frame. The shelf supporting means includes a plurality of spaced apart vertically extending wire cables 44, the cables 44 being secured at their upper ends to the top 16 of the frame and being anchored at their lower ends to the base 12, and the cables 44 being spaced apart such that they support the corners of the shelf units 18. While in the illustrated arrangement vertical elements 44 are described as being wire cables, it should be understood that they could also be rods.

Figure 6:
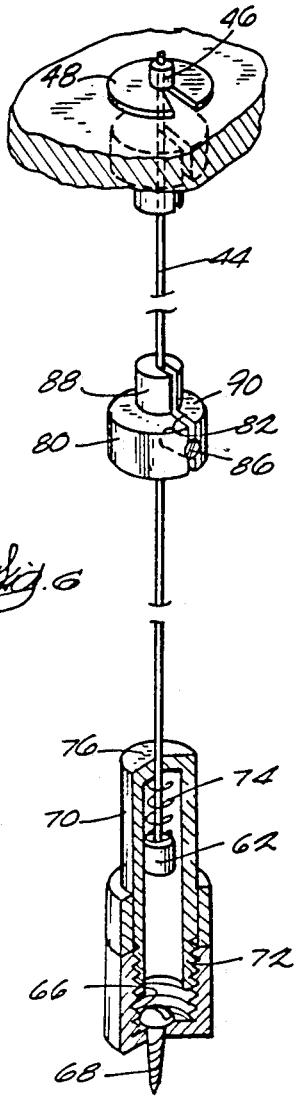
FIG. 6 is an enlarged illustration of a cable assembly illustrated in FIGS. 1–4.

While various means could be provided for securing the upper ends of the cables 44 to the top 16 of the frame, in the arrangement shown in FIG. 6, the upper end of each cable 44 extends through a hole provided in the top portion 16 and includes a stop member 46 surrounding that end of the cable and swaged in place so as to be rigidly secured to the cable. A slotted washer 48 is inserted between the stop member 46 and the upper surface of the top portion 16.

FIG. 6 also illustrates an arrangement for use in conveniently securing the lower ends of the cables 44 to the base 12. The lower end of the cable 44 also terminates in a stop member 62 swaged or otherwise fixed to the lower end of the cable. An anchor socket 64 having a central threaded bore 66 is secured to the base 12 by a screw 68. A threaded connector 70 houses the stop member 62 at the lower end of the cable 44, and the lower end 72 of the threaded connector 70 is threaded into the anchor socket 64. In the illustrated arrangement, a compression spring 74 surrounds the lower end of the cable 44 and is compressed between the stop member 62 and an end wall 76 of the threaded connector 70 so as to maintain downward pressure on the end of the cable 44 thereby maintaining tension in the cable.

The apparatus of the invention also includes a plurality of shelf supports 80 adapted to be supported by the cables 44 and providing a means for attaching or connecting the shelf units 18 to the cables 44 such that the shelf units 18 are individually supported by the cables 44 or easily removed from the display device 10, and wherein the vertical position of the shelf units 18 can be readily adjusted as required for the best display of the products. As best illustrated in FIG. 6, each shelf support 80 comprises a generally cylindrical member having a radially extending slot 82 extending from the periphery of the cylindrical member inwardly to its longitudinal axis, the slot 82 having a width slightly greater than the diameter of the cable 44 such that the cable can be housed in the slot 82. The shelf support 44 also includes a radially extending threaded bore 84 housing a set screw 86 for engaging the cable 44 and for releaseably locking the shelf support 80 in vertical position on the cable 44. The shelf support also includes an integral central upwardly projecting reduced diameter cylindrical portion 88, and an upwardly facing shoulder 90 surrounding the reduced diameter portion of the shelf support.

Figure 4:
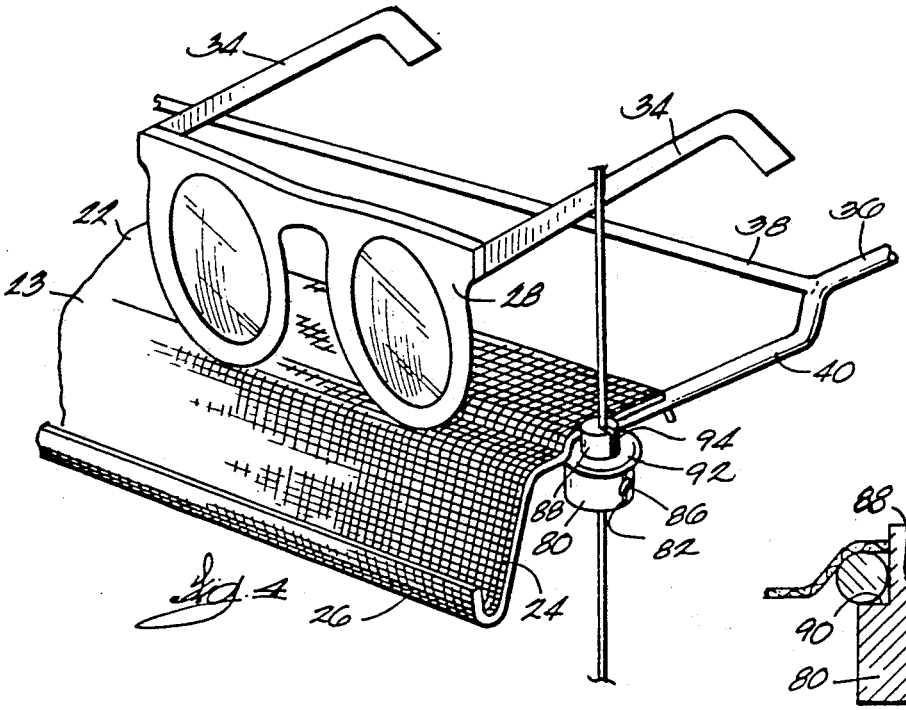
FIG. 4 is an enlarged partial perspective view of the display shelf shown in FIG. 3 supported by a support cable and supporting a pair of eyeglasses.
Figure 5:
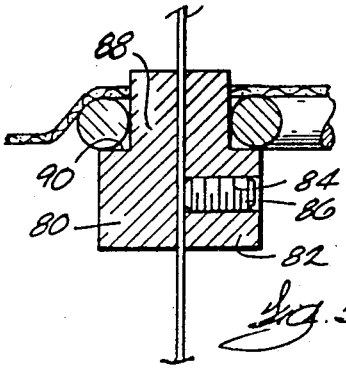
FIG. 5 is an enlarged cross section view of a shelf support shown in FIG. 4.

In a preferred form of the invention, the opposite ends of each of the rods 36 forming the ends of the shelf units 18 are curved as best shown in FIGS. 4–5 to form generally circular loops 92 outwardly but adjacent the ends of the shelves 22, the loops 92 being at each of the corners of the shelf unit 18. The loops 92 include an opening or slot 94 adapted to permit insertion of the cable 44 into the loops 92, and the loops 92 are adapted to rest on the shelf supports 80. In the illustrated arrangement each loop 92 defines a bore having a diameter slightly greater than the diameter of the upwardly projecting portion 88 of a corresponding shelf support 80 but less than the diameter of the body portion of the support member 80 such that the loop 92 can rest on the support member shoulder 90, with the upwardly projecting portion 88 housed in the central opening of the loop 92 and preventing lateral movement of the cable with respect to the loop.

Means are also provided for fixing the shelf support 80 to the cable 44 such that the position of the shelf unit 18 along the length of the cable 44 can be readily adjusted. In the illustrated arrangement this means includes a set screw 86 housed in a threaded bore 84 in the shelf support. The set screw 86 can be loosened to permit sliding movement of the shelf support 80 vertically along the length of the cable thereby permitting convenient adjustment of the vertical height of the eyeglass frame display shelves.

Removal or insertion of individual display shelves 18 is also conveniently achieved by lifting the shelves 18 upwardly off the support members 80 and then removing the cables 44 from the loops 92. The shelf 18 can then be removed from the shelf unit.

In other constructions of the shelf units 18, the shelf units 18 can also be provided with a central vertical screen supported at its opposite ends by the rods 36 forming the ends of the shelf units, and the screen providing a means for separating the two eyeglass frame supporting shelves 22 on opposite sides of the shelf unit.

Figure 7:
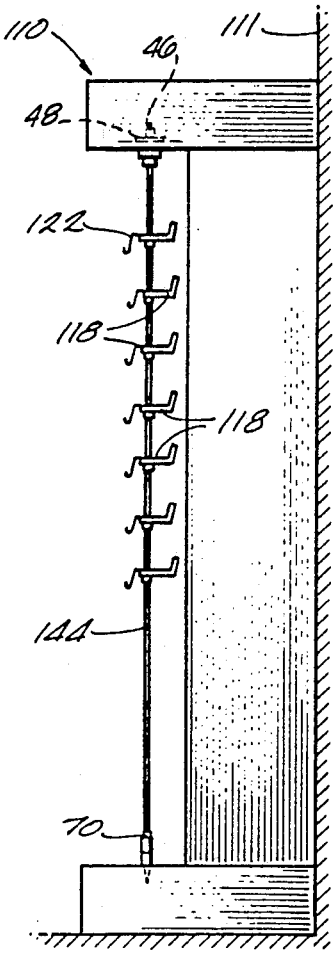
FIG. 7 is a side elevation view of an alternative embodiment of the display case shown in FIGS. 1–5.

FIGS. 7–8 illustrate an alternative embodiment of the invention and wherein a display device 110 is mounted against a wall 111, and the display device includes a plurality of vertically spaced apart shelf units 118, each shelf unit 118 being adapted to support a single row of eyeglass frames. The shelf units 118 of the display device 110 illustrated in FIG. 7 have the same construction as those shown in FIGS. 1 through 6 except that they include only a single shelf 122 for supporting eyeglass frames, and the shelf units 118 are supported by only a pair of vertical cables or rods 144, the cables or rods being located at the opposite ends of the shelf unit. The cables 144 are supported in the same manner as is illustrated in FIG. 6 and referred to above in connection with the embodiment of the invention shown in FIGS. 1–6. As best shown in FIG. 5, because the projections 88 of the shelf supports 80 extend through loops 92 and have a diameter closely approximating the inside diameter of the loop 92, the configuration of the loop 92 and the shelf supports 80 provides stable support for shelf 122 and facilitates support of the shelves 118 by only a pair of cables 144 without fore and aft rocking of the shelves.

Various features of the invention are set forth in the following claims.

I claim:

1. A display device for displaying eyeglass frames, the display device comprising;

a frame having a base and an upper portion spaced above the base, the upper portion and the base defining a display area therebetween, at least one elongated shelf adapted to support a plurality of pairs of eyeglass frames, and means for supporting the shelf between the upper portion and the base, the means for supporting the shelf including at least a pair of spaced apart vertical support members each having an upper end and a lower end, the upper end of each vertical support member being fixed to the upper portion of the frame, and the lower end of each vertical support member being fixed to the base, and each vertical support member having a shelf support member selectively adjustably supported thereon, each shelf support member being releaseably fixed to the respective vertical support member, the shelf support members being adapted to be positioned under portions of the shelf to support the shelf, the elongated shelf including opposite ends, a pair of spaced apart frame members at the opposite ends of the shelf, each of the spaced apart frame members defining an aperture adapted to house a respective one of the vertical support members, and an elongated article supporting surface extending between the spaced apart frame members, the shelf support members each including a first portion adapted to be housed in a respective one of the apertures defined by a respective one of the spaced apart frame members, and an upwardly facing support surface adapted to support a respective one of the opposite ends of the frame members, the shelf support members and the respective one of the frame members being separable.

2. A display device as set forth in claim 1 wherein the vertical support members are elongated rods.

3. A display device as set forth in claim 1 wherein the frame members include a pair of generally parallel rods, and wherein the elongated article supporting shelf is comprised of a product supporting shelf having opposite ends, one end of the product supporting shelf supported by one of the rods, and the other end of the product supporting shelf supported by the other of the rods, the product supporting shelf having a forward edge defining a trough portion adapted to house a portion of an eyeglass frame, and the product supporting shelf including a supporting surface rearwardly of the trough for supporting the temples of the eyeglass frame.

4. A display device as set forth in claim 3 wherein the vertical support members are cables and wherein the rods each include opposite ends, the opposite ends of the rods each defining a loop adapted to house a respective one of the cables and the loop being adapted to rest on the shelf support members.

5. A display device which can be installed in a retail establishment and which is free-standing, the display device comprising:

a base;

a vertical support member extending upwardly from the base and supported by the base, the vertical support member having an upper end;

a top supported by the upper end of the vertical support member;

a plurality of shelves having opposite ends for supporting merchandise, the shelves being supported in vertically stacked spaced apart relationship a pair of spaced apart frame members at the opposite ends of the shelf; and means for supporting the shelves, the means for supporting the shelves including a plurality of cables having upper ends secured to the top and lower ends secured to the base, and shelf support members fixed to the cables and supporting the spaced apart frame members thereon.

6. A display device as set forth in claim 5 and further including means for securing an upper end of the cable to the top, the means for securing including an upper anchor member fixed to the top, the anchor member including a threaded portion, a coupling portion attached to the end of the cable and adapted to threadably engage the upper anchor member, and means for securing the lower end of the cable to the base, the means for securing the lower end of the cable to the base including a lower anchor member fixed to the base, the lower anchor member including a threaded portion, and a lower threaded coupling attached to the lower end of the cable and adapted to threadably engage the lower anchor member.

7. A combination comprising:

a display shelf for displaying eyeglass frames, the display shelf including an elongated product supporting shelf having opposite ends, an elongated rod having an opposite end extending forwardly and rearwardly and supporting one end of the product supporting shelf and a second elongated rod having an opposite end extending forwardly and rearwardly and supporting an opposite end of the product supporting shelf, the opposite ends of the rods defining loops, each loop having a central aperture having a vertical longitudinal axis, and means for supporting the display shelf for adjustable vertical movement, the means for supporting including a plurality of vertical cables each of the vertical cables having upper ends and lower ends, means for anchoring the upper ends of the cables to a support and means for securing the lower ends of the cables to a second support, and shelf supports supported by the cables and for supporting the display shelf for vertical adjustable movement.

8. A combination as set forth in claim 7 wherein each shelf support includes means for gripping a selective one of the cables for adjustable vertical movement.

9. A combination as set forth in claim 7 wherein the shelf support members each include an upwardly projecting portion adapted to be housed in the respective apertures defined by the loops at the opposite ends of the rods.

10. A display shelf for supporting eyeglass frames, the display shelf comprising:

a frame, the frame including a pair of spaced apart end members at opposite ends of the shelf, the end members each being comprised of elongated rods and including opposite ends, the opposite ends each defining an aperture, and the apertures being defined by loops formed in the ends of the rods, the loops being formed around a generally vertical axis, and the loops being defined by curved end portions of the elongated rods, the curved end portions each having a space therein an eyeglass supporting shelf extending between the frame end members and having one end fixed to one of the frame end members and an opposite end fixed to the other of the frame end members, the supporting shelf including an upper supporting surface for supporting at least one eyeglass frame, the upper supporting surface of the supporting shelf including a forward generally linear edge portion adapted to support the lens frames of the eyeglasses to be supported and a rearward portion adapted to support the temples of the eyeglasses to be supported.

11. A display shelf as set forth in claim 10 wherein the supporting shelf further includes an inclined shelf face having a lower edge, the lower edge being curved upwardly and outwardly to define a trough adapted to house a portion of an eyeglass frame.

12. A display device for displaying eyeglass frames, the display device comprising:

a frame having a base and an upper portion spaced above the base, the upper portion and the base defining a display area therebetween, at least one shelf having opposite ends adapted to support at least one pair of eyeglass frames a pair of spaced apart frame members at the opposite ends of the shelf, and means for supporting the shelf between the upper portion and the base, the means for supporting the shelf including at least a pair of spaced apart vertical cables each having an upper end and a lower end, the upper end of each vertical cable being fixed to the upper portion of the frame, and the lower end of each vertical cable being fixed to the base, and each vertical cable having a shelf support member selectively adjustably supported thereon, at least a portion of the shelf support members having at least portions adapted to be positioned under portions of the spaced apart frame members to support the shelf.

13. A display device as set forth in claim 12 and further including means for securing the upper end of each cable to the upper portion of the frame, the means for securing the upper end of each cable including an upper anchor member fixed to the upper portion of the frame, the upper anchor member including a threaded portion, a coupling portion attached to the upper end of the cable and adapted to threadably engage the upper anchor member, and means for securing the lower end of one of the cables to the base, the means for securing the lower end of one of the cables to the base including a lower anchor member fixed to the base, the lower anchor member including a threaded portion, and a lower threaded coupling attached to the lower end of said one of the cables and adapted to threadably engage the lower anchor member.

14. A display device as forth in claim 12 wherein the shelf includes a shelf frame having a pair of spaced apart end frame members, each end frame member having opposite ends, the opposite ends of the end frame members each defining a generally circular aperture adapted to house one of the cables, and transverse frame members extending between the spaced apart end frame members and fixed to the end frame members to provide rigid support for the end frame members.

15. A display device as set forth in claim 14 wherein the shelf support members include generally cylindrical portions fixed to the cables and positioned beneath the opposite ends of the end frame members for supporting the shelves, the shelf support members being selectively adjustably supported on the cables for vertical adjustable movement.

16. A display device as set forth in claim 12 wherein the shelf includes a pair of spaced apart frame members, each of the frame members having opposite ends, each of the opposite ends of the frame members defining an aperture adapted to house a respective one of the vertical cables, and an article supporting surface extending between the spaced apart frame members, and the shelf support members each including a first portion adapted to be housed in a respective one of the apertures, and an upwardly facing support surface adapted to support a respective one of the opposite ends of the frame members.

17. A display device as set forth in claim 16 wherein the shelf support members are supported on the cables for vertical adjustable movement.

18. A display device as set forth in claim 12 wherein the shelf includes a frame, the frame including a pair of generally parallel rods, at least one product supporting shelf having opposite ends, one end of the shelf supported by one of the rods, and the other end of the shelf supported by the other of the rods, the product supporting shelf having a forward edge defining a trough portion adapted to house a portion of an eyeglass frame, and the shelf including a supporting surface rearwardly of the trough for supporting the temples of the eyeglass frame.

19. A display device as set forth in claim 18 wherein the rods each include opposite ends, the opposite ends of the rods each defining a loop adapted to house a respective one of the cables and the loop being adapted to rest on the support members.

20. A display device for displaying eyeglass frames, the display device comprising;

a frame having a base and an upper portion spaced above the base, the upper portion and the base defining a display area therebetween, at least one elongated shelf adapted to support a plurality of pairs of eyeglass frames, the elongated shelf including opposite ends, a pair of spaced apart frame members at the opposite ends of the shelf, each of the spaced apart frame members defining an aperture, and an elongated article supporting surface extending between the spaced apart frame members, and means for supporting the self between the upper portion and the base, the means for supporting the shelf including at least a pair of spaced apart vertical support cables each having an upper end and a lower end, the upper nd of each vertical support cable being fixed to the upper portion of the frame, and the lower end of each vertical support cable being fixed to the base, and each vertical support cable having a shelf support member selectively adjustably supported thereon, at least a portion of the shelf support members having at least portions adapted to be positioned under portions of the shelf to support the shelf, and the shelf support members each including a first portion adapted to be housed in a respective one of the apertures defined by the frame members, and an upwardly facing support surface adapted to support a respective one of the opposite ends of the frame members.

21. A display device as set forth in claim 20 wherein the shelf support members are supported on the cables for vertical adjustable movement.

22. A display device for displaying eyeglass frames, the display device comprising;

a frame having a base and an upper portion spaced above the base, the upper portion and the base defining a display area therebetween, at least one elongated shelf adapted to support a plurality of pairs of eyeglass frames, the elongated shelf including opposite ends, a pair of spaced apart frame members at the opposite ends of the shelf, each of the spaded apart frame members defining an aperture and an elongated article supporting surface extending between the spaded apart frame members, and means for supporting the shelf between the upper portion and the base, the means for supporting the shelf including at least a pair of spaced apart vertical support cables each having an upper end and a lower end, the upper end of each vertical support cable being secured to the upper portion of the frame, and the lower end of each vertical support cable being secured to the base, each vertical support cable having a shelf support member selectively adjustably supported thereon, at least a portion of the shelf support members having at least portions adapted to be positioned under portions of the shelf to support the shelf, and the shelf support members each including a first portion adapted to be housed in a respective one of the apertures defined by the frame members, and an upwardly facing support surface adapted to support a respective one of the opposite ends of the frame members, and means for securing the upper end of each cable to the upper portion of the frame, the means for securing the upper end of each cable including an upper anchor member fixed to the upper portion, the upper anchor member including a threaded portion, a coupling portion attached to the end of one of the cables and adapted to threadably engage the upper anchor member, and means for securing the lower end of one of one of the cables to the base, the means for securing the lower end of the cables to the base including a lower anchor member fixed to the base, the lower anchor member including a threaded portion, and a lower threaded coupling attached to the lower end of one of the cables and adapted to threadably engage the lower anchor member.

23. A display device for displaying eyeglass frames, the display device comprising;

a frame having a base and an upper portion spaced above the base, the upper portion and the base defining a display area there between, at least one elongated shelf adapted to support a plurality of pairs of eyeglass frames, the elongated shelf including opposite ends, a pair of spaced apart elongated rods at the opposite ends of the shelf, each of the spaced apart opposite ends and the elongated rods forming a loop at each of the opposite ends, and an elongated article supporting surface extending between the spaced apart elongated rods, and means for supporting the shelf between the upper portion and the base, the means for supporting the shelf including at least a pair of spaced apart vertical support members each having an upper end and a lower end, the upper end of each vertical support member being fixed to the upper portion of the frame, and the lower end of each vertical support member being fixed to the base, and each vertical support member having a shelf support member selectively adjustably supported thereon, at least a portion of the shelf support members having at least portions adapted to be positioned under portions of the shelf to support the shelf, and the shelf support members each including a first portion adapted to be housed in a respective one of the apertures, and an upwardly facing support surface adapted to support a respective one of the opposite ends of the frame members.

* * * * *